United States Patent [19]

Mountjoy et al.

[11] 3,986,457

[45] Oct. 19, 1976

[54] ELECTRONIC TIME OPENER AND OPENER SETTER SYSTEM

[75] Inventors: Garrard Mountjoy, Wilmot; Nelson D. Foley, Little Rock; William S. Marks, Little Rock; Gerald A. Mills, Little Rock; Alvin R. Hof, Little Rock; Holland O. Tyler, Conway, all of Ark.

[73] Assignee: The United States of America as represented by the Secretary of the Army, Washington, D.C.

[22] Filed: July 25, 1975

[21] Appl. No.: 599,206

[52] U.S. Cl. ..... 102/70.2 R; 89/1.5 R

[51] Int. Cl.[2] ..... F42C 11/06; F42C 19/06; F42C 15/40

[58] Field of Search ..... 89/1.5 R; 102/70.2 R

[56] References Cited

UNITED STATES PATENTS 3,088,408 5/1963 Richardson ..... 89/1.5 R

*Primary Examiner*—Samuel W. Engle
*Assistant Examiner*—Thomas H. Webb
*Attorney, Agent, or Firm*—Nathan Edelberg; A. Victor Erkkila; Max Yarmovsky

[57] ABSTRACT

An electronic time opener and opener system is utilized for initiating the opening of a plurality of munition cannisters at an accurate settable time after ejection from a high speed aircraft. Analogue circuitry is used in the opener setter to measure the capacitance of an RC circuit of the electronic time opener, immediately prior to cannister ejection. Upon the basis of this pre-ejection measurement a proper voltage charge is generated to obtain sufficient energy to actuate a detonator in the munition at the proper time. The combined opener and opener setter system permit accurate tuning while using wide tolerance capacitance components in the electronic time opener.

3 Claims, 9 Drawing Figures

ELECTRONIC TIME OPENER AND OPENER SETTER SYSTEM

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the past to accurately set the firing time of a munition after it has been released from its carrying vehicle. Keeping the munition in a "safe" unarmed condition is necessary to protect the carrying personnel in the event of a firing time malfunction. One of the ways of solving this problem in the past has been to use mechanical time clock fuzes which were initiated by a lanyard. The problem with mechanical time clock fuzes is that once they are set to function at a particular setting they cannot be easily changed. This problem is particularly vexing when dealing with deployment of munitions from a high speed aircraft the delivery height and speed of which are desired to be kept as flexible as possible to meet unpredictable changing conditions over the target area.

SUMMARY OF THE INVENTION

This invention relates to removable multiple settable electronic openers and an opener setter for a munition device which can be ejected from a cannister being carried by a high speed aircraft. The electronic openers are connected through switches to a setter in common with all the openers. The setter has an initial charge of low energy thereon. When the opener is dispensed from the aircraft the opener switch assembly, during the first quarter inch of travel, causes the connection of a firing and charging capacitor to be transferred from ground to the setter charge lines. The function of the displacement sensitive switches are to connect the opener to the setting line so that a timing and firing capacitor may be charged to the degree required for a specific selected time setting. Only two micro-switches are required to make the initial connections. The wiping out of an initial charge on the opener signals the setter to go through its charging cycle. The setter and openers are so designed that an opener being charged will receive a compensated charge which will enable it to yield the required time to open without regard to variation in capacitance of the two capacitors. A variation in capacitors is sensed by the setter and the charge is automatically regulated to produce a substantially exact time for a relatively wide tolerance component. The switching system is such that once an opener is dropped clear of the carrying aircraft, it tears away and leaves the lines unaffected by the opener. The time that an opener is kept on a setting line may be only a few milliseconds. The setter circuitry is therefore so designed as to perform its complete charging cycle in approximately the first six inches of drop of the opener.

An object of the present invention is to provide an electronic time opener and opener setter system which is capable of initiating the opening of a plurality of munition cannisters at an accurate settable time after ejection from a high speed aircraft.

Another object of the present invention is to provide an electronic time opener and opener setter system which allows the opener initiating time to be substantially accurately set without utilization of close tolerance expensive capacitative elements in an RC timing circuit.

Another object of the present invention is to provide an accurate electronic time opener and opener setter for a munition dispenser, wherein the setter senses the capacitance of an RC timing circuit immediately prior to functioning so that variations in capacitance caused by age or ambient temperature and pressure conditions are accurately compensated for.

A further object of the present invention is to provide an accurate electronic time opener and opener setter system for a munition dispenser which allows flexibility of flight profile for a dispensing aircraft while maintaining a desired munition dispersion pattern over a target area.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
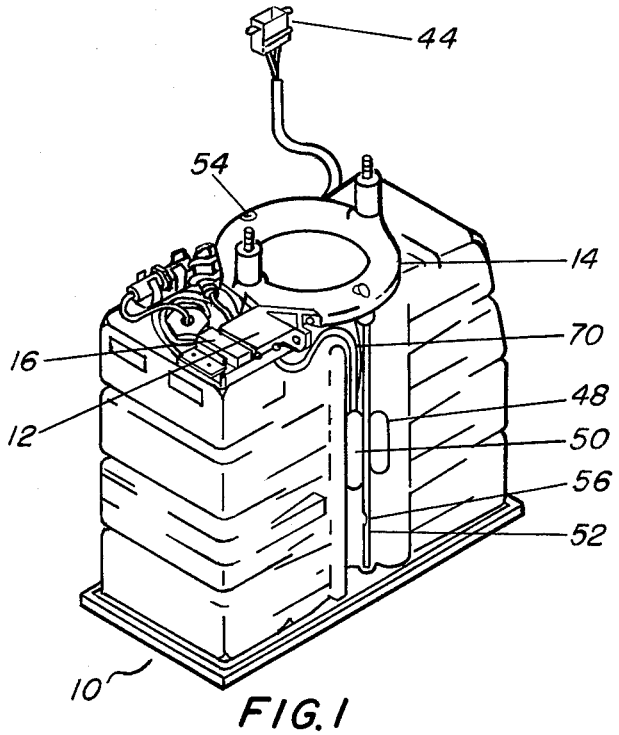
FIG. 1 is an isometric view of a munition cannister assembly.
Figure 2:
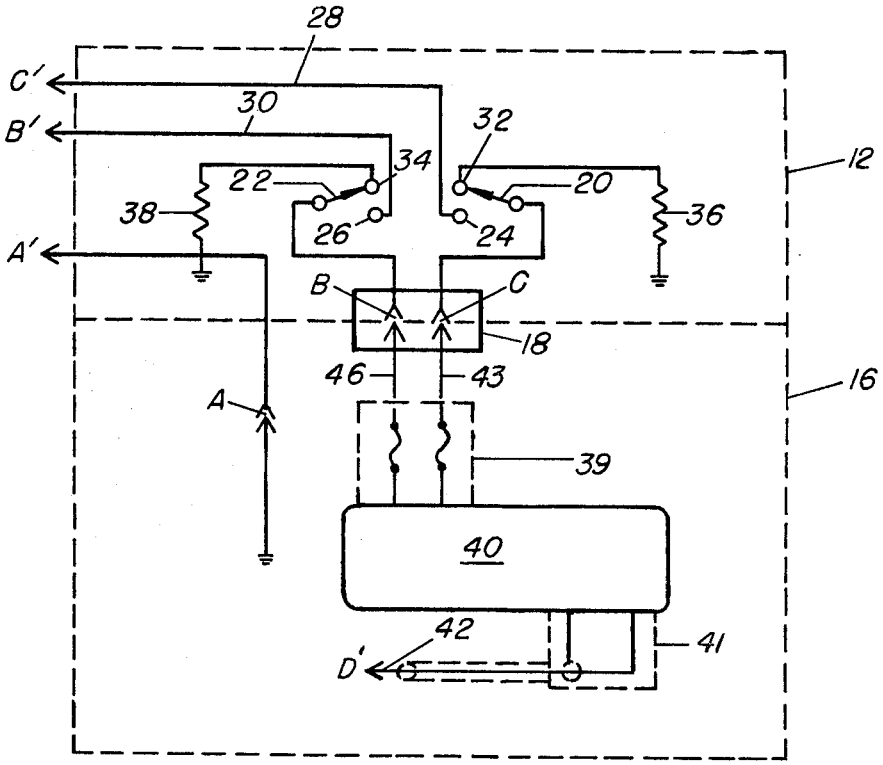
FIG. 2 is a schematic view of the electronic opener-switch assembly circuit before first motion of the munition cannister.

Referring now to FIGS. 1 and 2 a cannister assembly 10 has a switch assembly 12 mounted to a cannister retention ring 14. An electronic timer opener 16 is mounted adjacent switch assembly 12. The cannister assembly 10, in its initial condition prior to initiation of ejection, has opener switch assembly 12 electrically connected to the opener assembly 16 through connector 18. The opener switch assembly 12 is in turn connected to the output of an opener setter circuit, to be described hereafter, through plugs A′, B′ and C′. Plugs A′, B′ and C′ electrically connect the output of the opener setter circuit to the electronic opener 12. Plug C′ supplies energy for a firing capacitor charging circuit. Plug B′ supplies energy for a timing capacitor circuit and plug A′ provides an electrical connection between chasis grounds. Before first motion of the cannister assembly 10 displacement micro-switches 20 and 22 present open terminals 24 and 26 to the firing cspacitor and timing capacitor setter charge lines 28 and 30 and closed grounded terminals 32 and 34, through resistance 36 and 38 respectively, in the opener 16 to assure that there is an initial "zero charge" condition thereon. Dashed lines 39 and 41 represent electrostatic shields to the input charge lead 43 and 46 and the output lead 42 of the opener circuit 40. The output of opener circuit 40 is connected to a detonator by plug D′ (not shown) through a shielded electrical conductor 42.

When a firing button in the aircraft is depressed a voltage is applied through cannister electrical cable connector 44 to the ignition bridge of a squib in the ejection cartridges 48 and 50. Ignition of an explosive charge in cartridges 48 and 50 generates pressure in an ejection piston (not shown) which applies a tension force against retention rods 52 and 54. When sufficient pressure is exerted by the expanding gases, the retention rods 52 and 54 break at the stress concentration points 56, allowing cannister motion to begin.

Figure 3:
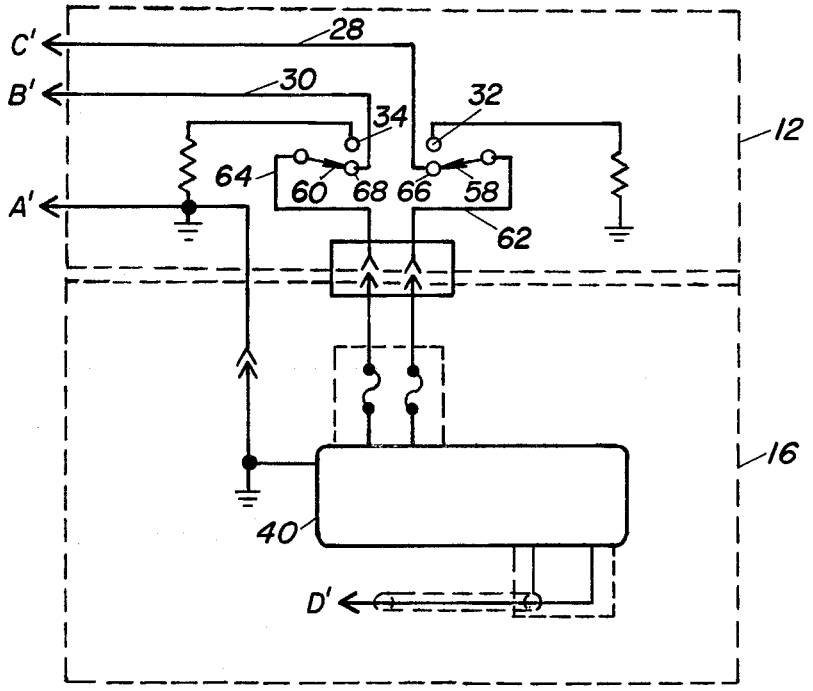
FIG. 3 is a schematic view of the electronic opener-switch assembly circuit after 0.080 to 0.150 inches of travel.

Referring now to FIGS. 1 and 3, after approximately one-eighth of an inch of movement, the pole pieces 58 and 60 of the first and second displacement switches 20 and 22 respectively, transfer their respective input capacitor charge lines 62 and 64 from grounding terminals 32 and 34 respectively, to the setter charge lines 28 and 30 through switch terminals 66 and 68 respectively. Connection of a timing capacitor (to be described in detail hereinafter), in the opener 40, to the setter output through plugs A′, B′, C′, initiates a charging cycle, to be described later, which occurs during approximately the next five inches of travel of the electronic opener assembly 16.

Figure 4:
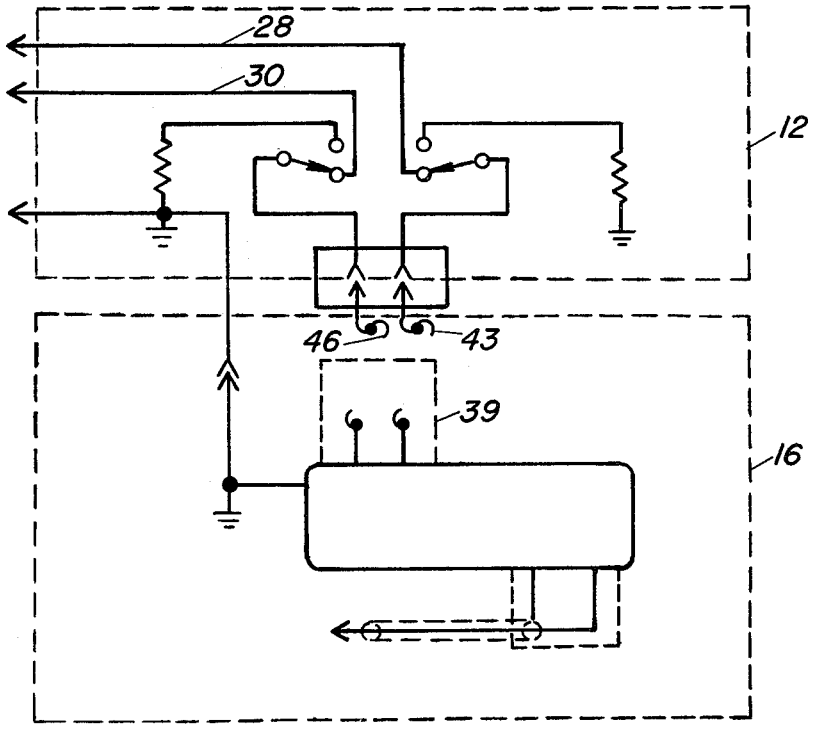
FIG. 4 is a schematic view of the electronic opener-switch assembly circuit after approximately 4 ½ inches of travel.
Figure 5:
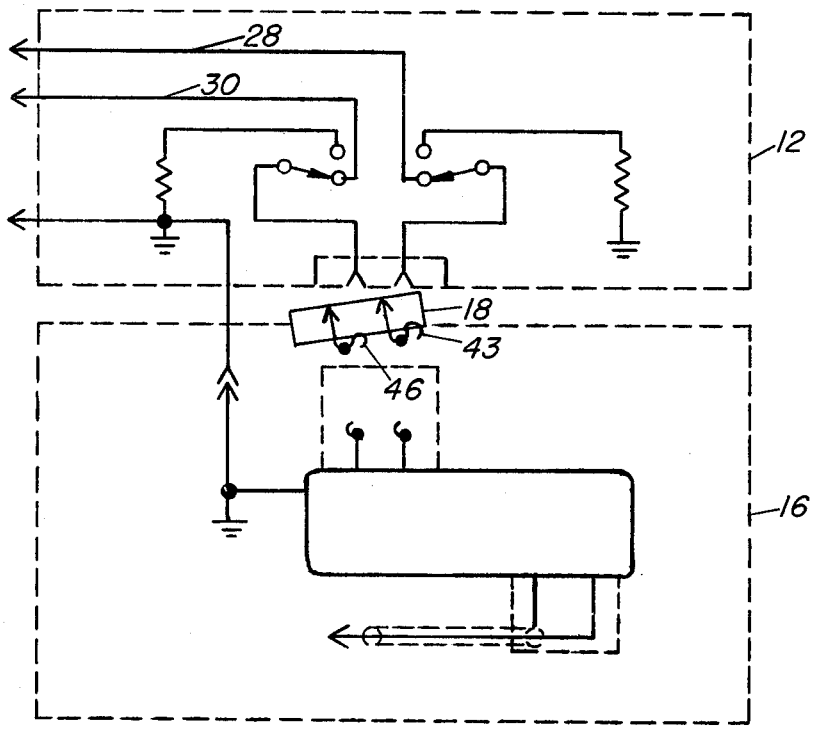
FIG. 5 is a schematic view of the electronic opener-switch assembly circuit after approximately 5 ¼ inches of travel.
Figure 6:
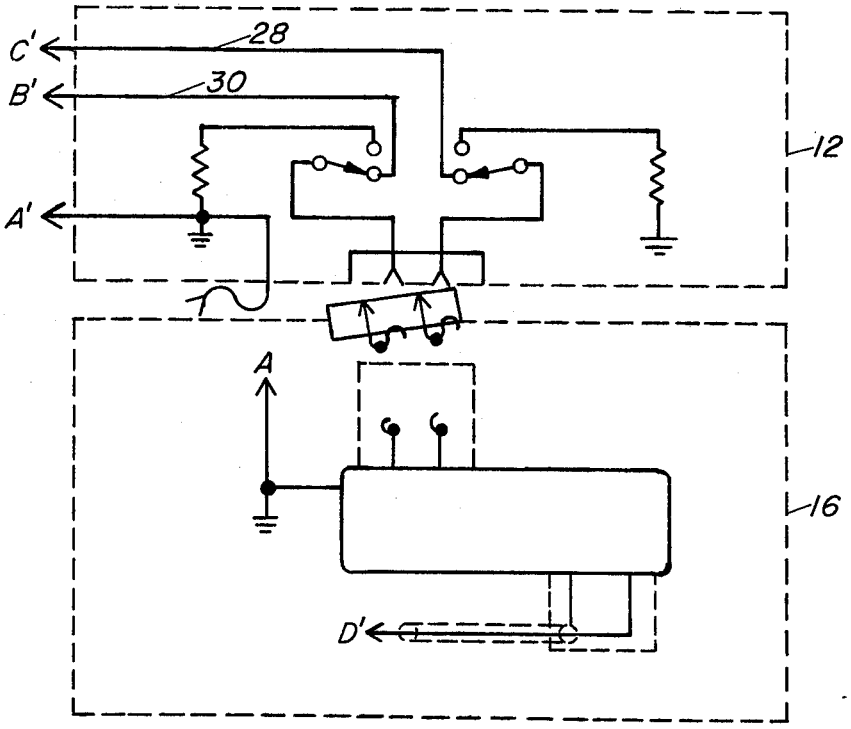
FIG. 6 is a schematic view of the electronic opener-switch assembly circuit after approximately 7 inches of travel.

Referring now to FIGS. 1 and 4 a lanyard 70 connected to the switch assembly breaks the opener input charge leads 43 and 46 from the opener input inside the electrostatic shield 39. Referring to FIG. 5, after an additional inch of travel a second lanyard, not shown, attached to the opener 16 separates the connector 18 removing the severed charge leads 43 and 46 from the switch assembly 12. The ejection velocity imparted to the cannister 10 by the piston (not shown) is approximately 24 feet per second. Referring to FIG. 6, after about 12 inches of travel, a lanyard, not shown, attached to the dispenser removes a short from a detonator, not shown, which is connected to a detonator output D and also opens ground lead connector A, thus arming the cannister 10 and freeing it from the opener switch assembly 12 and the dispenser. The cannister 10 falls until a set time has elapsed, when its charged opener 40 initiates the detonator, which, after delay, bursts the cannister and dispenser submunitions thus completing the functional cycle of a single cannister assembly.

As will be seen hereinafter from a discussion of the opener circuit 40 of FIG. 7 and the opener setter block diagram of FIG. 8, a unique feature of this system is that the connection, measurement, power, and supply of timing intelligence to each opener is accomplished after irrevocable commitment of the individual cannister to be dispensed.

Figure 7:
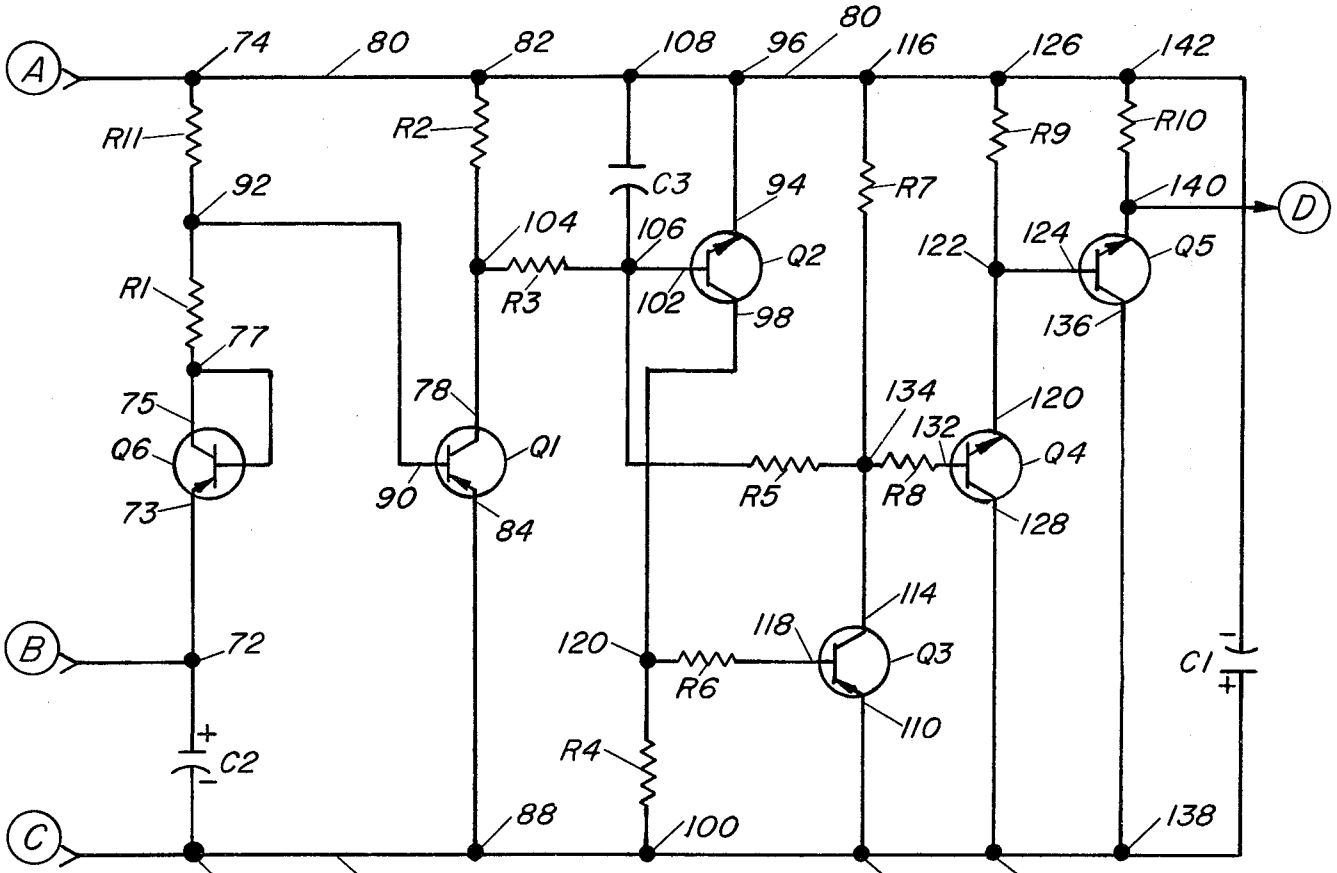
FIG. 7 is a schematic circuit diagram of the electronic opener.

Referring now to FIG. 7, the major elements of the opener circuit are a timing capacitor C2, a timing resistor R11, a dual function power supply-firing capacitor C1, and a trigger and firing circuit interconnected therebetween. The positive side of timing capacitor C2, is electrically connected at junction point 72 to jack B which is in turn connected through connector 18 and plug B′ in FIG. 2 to the opener setter timing capacitor charging circuit to be discussed later. Timing capacitor C2 positive side is electrically connected in series with a timing resistor R11 through a diode connected transistor O6 whose emitter electrode 73 is connected to junction point 72 and whose collector electrode 75 is connected to one end of a fine adjustment resistor R1 at junction point 77. The other end of resistor R1 is connected to one end of timing resistor R11 at junction 92. The other end of timing resistor R11 is connected to jack A, which is a common reference point for the opener circuit at junction point 74. The negative side of timing capacitor C2 is electrically connected to jack C, which is in turn connected to the firing capacitor charge lead of the opener setter. Power supply capacitor C1 has its positive terminal electrically connected to the negative side of capacitor C2 at junction point 76 and its negative terminal to common reference point jack A at junction point 74 so that it is in parallel with the series combination of timing resistor R11, fine adjustment resistor R1, diode connected transistor Q1 and timing capacitor C2.

A trigger imput transistor Q1 has its collector electrode 78 electrically connected to one end of resistor R2 whose other end is connected to common reference line 80 at junction point 82, an emitter electrode 84 is electrically connected to firing capacitor charge conductor 86 at junction 88, and a base electrode 90 is electrically coupled intermediate resistor R1 and R11 at junction point 92. A first high gain amplifier transistor Q2 has an emitter electrode 94, which is electrically coupled to common lead line 80 at junction point 96, a collector electrode 98 is electrically connected to a resistor R4 which is connected in turn to firing capacitor charge lead 86 at junction 100. The base electrode 102 of transistor Q2 is electrically connected to a resistor R3 which is in turn coupled intermediate trigger input transistor Q1 and resistor R2 at junction point 104. A transient suppression capacitor C3 is electrically coupled on one end intermediate amplifier transistor Q2 and resistor R3 at junction 106 and at its other end it is electrically coupled to common line 30 at junction 108. A second high gain amplifier Q3 has its emitter electrode 110 electrically connected to the firing charge conductor 86 at junction point 112, a collector electrode 114 is electrically coupled to one end of resistor R7 whose other end is electrically connected at junction point 116 to common reference line 80, and a base electrode 118 is electrically connected to one end of resistor R6 whose other end is connected to junction point 120 which is intermediate to the electrical connections between resistor R4 and the first amplifier collector electrode 98. Transistor Q4 is an emitter follower driver stage for the output transistor Q5. The emitter electrode 120 is electrically connected at junction 122 to the base electrode 124 of output transistor Q5 and to one end of resistor R9. The other end of resistor R9 is electrically connected at junction point 126 to common reference lead 80. The collector 128, of the follower transistor Q4 is electrically connected directly to the firing capacitor charge conductor 86 at junction point 130. The base electrode 132 of transistor Q4 is electrically coupled to one end of resistor R8 whose other end is electrically connected at junction point 134 intermediate the electrical connection between resistor R7 and the collector 114 of transistor Q3. A feedback resistor R5 has one end electrically coupled to junction point 134 and its other end electrically connected to junction point 106. The collector electrode 136 of output transistor Q5 is connected to the positive terminal of the firing capacitor C1 and the capacitor charge conductor 86 at junction point 138. The emitter electrode of transistor Q5 is electrically connected at junction point 140 to detonator terminal D and to one end of resistor R10, the other end of resistor R10 is electrically connected at junction point 142 to the negative electrode of firing capacitor C1 and the common line 80. In this specific embodiment the circuit elements have the following values:

C1 = 47 u F
C2 = 6.8 u F
C3 = 1000 pf
R1 = 4.7 K ohms
R2 = 100 K ohms
R3 = 10 K ohms
R4 = 22 K ohms
R5 = 100 K ohms
R6 = 4.7 K ohms
R7 = 10 K ohms
R8 = 47 ohms
R9 = 1 K ohms
R10 = 100 ohms
R11 = 5 Meg ohms
Q1 = 2N4285 or SKB 2949
Q2 = 2N4287 or 2N3711
Q3 = 2N4285 or SKB2949
Q4 = 2N4287 or 2N3711
Q5 = 2N3794 or 2N3704
Q6 = 2N4285 or SKB2949

Figure 8:
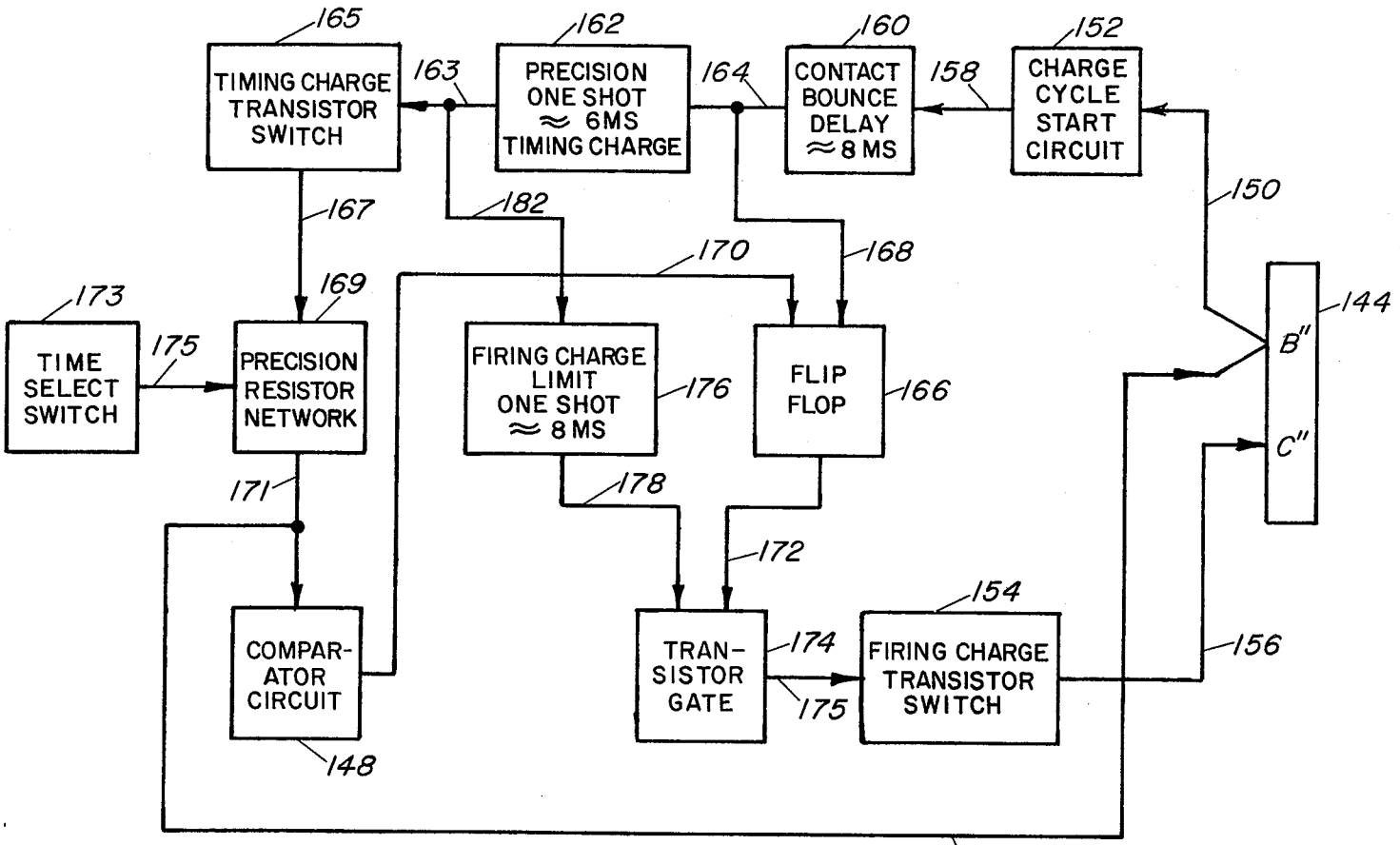
FIG. 8 is a block diagram of the electronic opener circuit.
Figure 9:
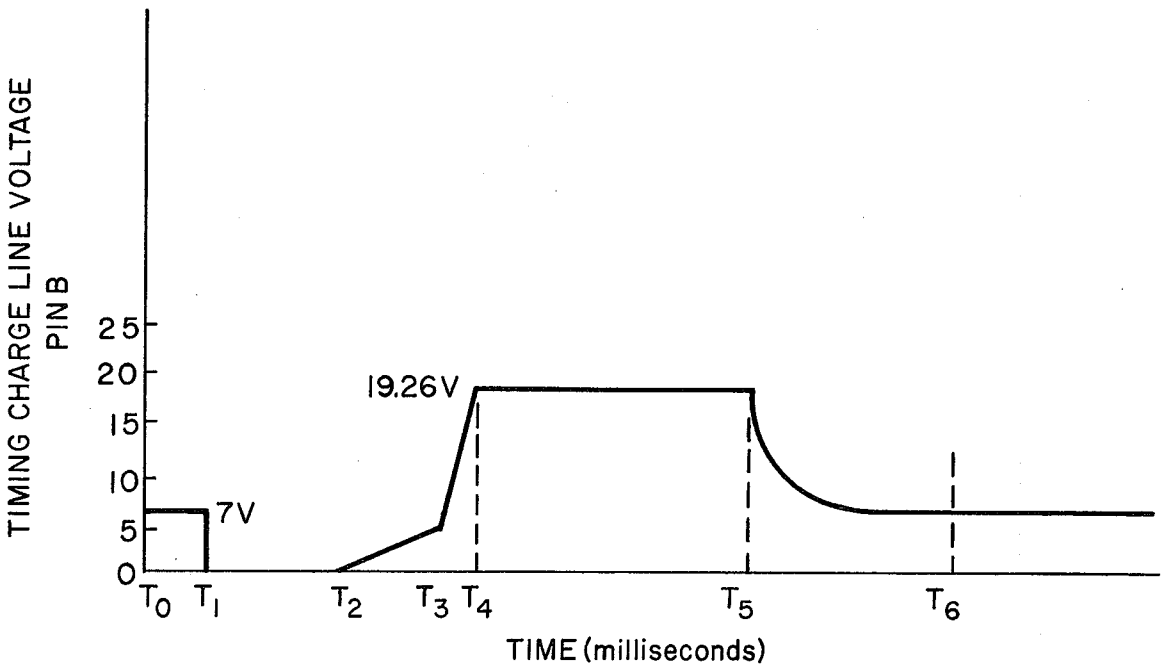
FIG. 9 is a typical charge curve of the timing capacitor of the electronic opener.

Referring now to FIGS. 2–9, the operation of the circuit shown in FIG. 7 begins after the opener 16 has been charged in two steps by the opener setter circuit of FIG. 8. The opener setter of FIG. 8 initially applies an initial positive potential on the timing capacitor C2, of seven volts with reference to common, which is proportional to a desired delay time. Closure of switches 20 and 22, shown in FIG. 3, which connects the timing capacitor C2 to the opener setter of FIG. 8, forms a momentary low impedance due to capacitive loading. The dual function power supply-firing capacitor C1 is sequentially charged at time $t_2$ so that the timing capacitor C2 is raised from zero potential to a controlled level of 19.26 volts at time $t_4$. The zero potential of the charge curve of the timing capacitor C2 during time $t_1$ to $t_2$, approximately 7.5 milliseconds, is controlled by a contact bounce delay 160 circuit, to be further described hereinafter in the opener setter, thus allowing for switch bounce. The charge curve of the timing capacitor C2 during the time interval $t_2$ to $t_3$, of 6 milliseconds, is controlled by the selection of a particular value of resistance in precision resistor network 169 in the opener setter through which the timing capacitor C2 is charged. The timing capacitor charge curve from $t_3$ to $t_4$ is determined by the rate that the supply-firing capacitor raises the reference of the timing capacitor C2. At point $t_4$ the sum of the voltage of the two capacitors C1 and C2 satisfies a preset voltage on a comparator 148 in the setter electronics, which then causes the charge cycle to stop. At time $t_5$ the opener 16 breaks electrical contact with the setter and the setter returns to its quiescent level at $t_6$ and is ready to repeat the cycle and charge the next opener 16. When the opener 16, as shown in FIG. 6 and 7, is disconnected from the charging circuit of FIG. 8 by canister ejection, the transistors Q1–Q5 are biased so as to be nonconductive. Current flows from timing capacitor C2 through the timing resistor R11 and the compensation networks, R1 and Q6, into the supply-firing capacitor C1 until the potential of the charging curve at $t_1$ attains a zero potential with reference to a point on the curve at $t_2$. At time $t_2$ the potential on the base electrode 90 of the trigger input transistor Q1 has reached the conduction threshold, and a regenerative firing function is initiated. Threshold conduction of the trigger input transistor Q1 is amplified by the high gain circuit of transistors Q2 and Q3, with regenerative action affected by positive feedback through resistor R5, causing avalanche discharge of the supply-firing capacitor C1 through the output transistor Q5 and the low impedance of a detonator (2–5 ohms) which is connected between the output lead D and the common jack A. Transistor Q4 is an emitter follower driver stage for the output transistor Q5. The capacitor C3 is a transient and noise suppression capacitor to prevent the opener circuit of FIG. 7 from prematurely discharging during the charge cycle.

The following equation defines the theoretical time relationship:

$$\frac{Tf}{Tx} = \frac{Rt}{Rx} \text{ or } Tf = \frac{TxRt}{Rx}$$

where:

*Tf* is the opener 16 firing time.
*Tx* is the accurate charge time for the timing capacitor C2.
*Rx* is the precision resistor, not shown, through which the timing capacitor is charged. (Selected by control unit.)
*Rt* is the precision resistor R11 through which the timing capacitor C2 is discharged.

The voltage potential on the capacitors C1 and C2 is such that the timing capacitor C2 would actually be charged in the reverse direction (negative) if the trigger circuit did not provide a discharge for the power supply-firing capacitor. All transistors are biased off and, therefore, do not draw current until the timing capacitors C2 voltage has discharged to 0 volts. This is a requirement of the compensation for the RC circuit to enable the use of wide tolerance capacitors. The RC charge circuit of the electronic opener is such that the timing capacitor C2 and power supply-firing capacitor C1 are charged in series through a selected precision resistor not shown for a specific and accurate time period. The RC discharge circuit of the electronic opener discharges the same two capacitors connected in series through a larger but fixed precision resistor R11. The charge of the power supply-firing capacitor C1 is such that the charging and discharging voltage source potential applied to the timing circuit are the same. Therefore, the equation above equates the ratio of the precision times to the ratio of the precision resistors. The capacitor values and, therefore, their tolerance variations are compensated for by the charge and discharge relationship of the electronic opener.

As stated above, it is necessary to hold the trigger circuit from conduction until the timing capacitor has discharged to 0 volts. The fact that the emitter-base junction of transistor Q1 has a threshold conduction of approximately 0.6 volts requires that a like compensation voltage offset be in the discharge circuit. Transistor Q6, the same type as Q1, is connected as a diode to give most of this compensating offset voltage. Resistor R1 is used in series with Q6 for a fine adjustment of this voltage offset since Q6 is conducting and, therefore, has a slightly smaller voltage drop than the turn-on voltage required for Q1.

Transistor Q1 starts to conduct when the timing capacitor C2 has discharged to zero volts. This causes a voltage drop across the collector resistor (R2), which in turn provides a forward bias to the high gain amplifier circuit (Q2 and Q3). Transistor Q2 conducts and develops a forward bias to transistor Q3. Transistor Q3 conducts and, with the positive regenerative feedback through resistor R5, puts the high gain amplifier into hard conduction. The conduction of the high gain amplifier provides adequate base current to transistor Q4, which is connected as an emitter follower driver stage. Transistor Q4 is therefore able to drive the output transistor (Q5) into high current conduction. This provides a path for the power supply-firing capacitor to discharge through transistor Q5 and the low impedance electric detonator to perform the opener function.

Referring now to the block diagram of the opener setter circuit of FIG. 8 and FIGS. 1 and 3, the setter cycle begins automatically when opener circuit 40 is connected to the charge lines 28 and 30 from the opener setter. This occurs when a cannister 10 is ejected, and on first motion allows switch assembly 12 to make connection so that switch pole pieces 58 and 60 are moved from terminal 32 and 34 to 66 and 68 respectively. Pin B″ of setter connection 144 is connected to the timing charge line 30 through plug B′ of FIGS. 2–6 and within the setter it is electrically connected through conductor 146 to the input of a comparator circuit 148. Pin B″ is also electrically connected via conductor 150 to the input of a charge cycle start circuit 152. The firing capacitor charge line 28 of FIGS. 2-6 is connected to pin C″ of connector 144. The charge bus line 28 carries the charge from the output of a firing charge transistor switch circuit 154 via conductor 156 to the firing capacitor C1 in FIG. 7 through plug C.

Only one opener is attached to the setter of FIG. 8 during a charge cycle, and the setter senses the presence of the opener through pin B″. This lead has a normal quiescent bias of approximately 7 volts. As previously stated this voltage immediately drops to near zero volts due to the capacitive loading of the opener 16. The voltage drop is transferred through the charge cycle start 152 circuit which sends a signal via conductor 158 which starts a contact bounce delay one-shot 160 of approximately 8 milliseconds. The contact bounce delay 160 allows the contacts of switches 20 and 22 of switch assembly 12 to make good contact so that proper charging can begin. The time of this contact bounce delay is approximately 7.5 milliseconds. The positive excursion of the pulse from contact bounce delay 160 triggers a precision oneshot timing charge circuit 162 via conductor 164. The time of this precision one-shot 162 is approximately 6 milliseconds and is controlled by precision resistances and capacitor C1 therein. The output of precision one-shot 162 is transferred via conductor 163 to a timing transistor switch 165. Timing charge transistor switch 165 is biased on by precision one-shot timing charge 162, and couples the timing charge voltage to the opener timing capacitor C2 via conductor 167 through a precision network 169 and thence to the terminal B″ of connector 144 via conductors 171 and 146. A time select switch 173, which is connected to the precision resistor network 169 via conductor 175, permits a pilot to adjust the precision resistor network 169, from his cockpit, to a plurality of time settings and to a "safe" or nonoperative position.

The 7. milliseconds pulse from the contact bounce delay 160 also resets a flip-flop circuit 166 through conductor 168. The flip-flop circuit 166 detects via electrical conductor 170 the transition of the comparator 148 when the charge cycle is to be stopped.

The output of flip-flop 166 via conductor 172 controls one-half of the transistor gate 174 for charging the firing capacitor C1 via electrical conductor 156. The other half of the transistor gate 174 is controlled by the output of a firing charge limit one-shot 176 via conductor 178. The firing charger limit one-shot 176 limits the time to a maximum of 8 milliseconds for charging the firing capacitor C1. This protects the setter should the firing capacitor be shorted or, for some reason, not take a charge. The firing charge limit one-shot 176 is triggered by the precision one-shot via conductor 182, and starts the charging of the firing capacitor C1 immediately upon completing the charge of the timing capacitor C2. The transistor gate 174 then turns firing charge transistor switch 154 on via conductor 175, and charges the firing capacitor C1. As the charge on the timing capacitor C2 is completed and the firing capacitor C1 is being charged, the comparator circuit 148, monitors the sum of the voltage on the capacitors C1 and C2. When a preset voltage level is reached, the comparator circuit 148 switches, the flip-flop 166 via lead 170 so that transistor gate 174 opens, thus stopping the charging of firing capacitor C1.

After the setter charge cycle, as aforedescribed, has been completed, the setter opener 16 electrical contact with switch assembly 12, as shown in FIG. 6, is broken as the opener 16 is ejected. The setter circuit of FIG. 8 returns to its quiescent condition and is ready to charge the next opener 16.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. An apparatus for initiating the opening of a plurality of munition cannisters at an accurate settable time after each of said cannisters are ejected from a high speed aircraft which comprises:

electronic time resistance-capacitance opener means for providing selectable time settings for munition dispersion of said cannisters from said aircraft;

opener setter means for sensing the charge potential of the capacitance of said electronic time opener means and for charging said opener means for an accurate time delay; and switch means for electrically connecting said opener means to said setter means.

2. An apparatus as recited in claim 1 wherein said electronic time opener means comprises:

a precision resistor having a first end electrically connected to a common ground lead and a common jack;

conduction voltage compensation means having one end electrically coupled to the other end of said precision resistor through a first resistor;

a timing capacitor having a positive electrode electrically connected to the other end of said voltage compensation means, a negative electrode connected to a firing capacitor charge lead which is in turn electrically connected to said opener setter means, the junction between said voltage compensation means and said positive electrode being connected to a timing capacitor charge lead;

a power supply-firing capacitor having a positive terminal electrically connected to said firing capacitor charge lead and a negative terminal electrically coupled to said common lead;

a trigger input transistor having a collector electrode electrically coupled to the first end of said precision resistor through a second resistor, an emitter electrode electrically connected to said firing capacitor charge lead, and a base electrode electrically connected intermediate said precision resistor and said first resistor;

a first high gain amplifier transistor having an emitter electrode electrically coupled to said common ground lead, a base electrode electrically connected through a third resistor to a junction point intermediate said trigger input transistor and said second resistor, and a collector electrode electrically connected through a fourth resistor to said firing capacitor charge lead;

a transient suppression capacitor having one terminal electrically connected intermediate the base electrode of said first high gain transistor and said third resistor, and the other terminal electrically connected to said common lead;

a second high gain amplifier transistor having an emitter electrode electrically coupled to said firing capacitor charge lead, a collector electrode electrically coupled through a fifth feedback resistor to a common junction point between said suppression capacitor, said third resistor and the base electrode of said first high gain transistor, a base electrode electrically connected through a sixth resistance to a junction point intermediate said fourth resistor and the collector electrode of said first high gain amplifier transistor;

an emitter follower driver transistor having a collector electrode electrically connected to said firing capacitor charge lead, a base electrode electrically connected to one end of an eighth resistor said eighth resistor's other end electrically coupled to a common junction point of said fifth feedback resistor and said collector electrode of said second high gain amplifier transistor, said common junction point being electrically coupled via a seventh resistor to said common lead, and an emitter electrode connected to said common lead via a ninth resistor; and an output transistor having a collector electrode electrically coupled to said firing capacitor charge lead, a base electrode electrically connected intermediate said ninth resistor and said emitter electrode of said follower transistor, and an emitter electrode electrically coupled to said common lead via a tenth resistor; and wherein the voltage potential applied to said timing and firing capacitors through said common lead and said timing capacitor charge lead and said firing capacitor charge lead is such that said timing capacitor would be charged in the reverse direction if said trigger transistor did not provide a discharge for said power supply-firing capacitor; said trigger transistor, said first and second high gain amplifier transistors, said follower transistor and said output transistor being biased to cut off and therefore not drawing current until said timing capacitor voltage has discharged to zero which then causes said trigger transistor to conduct and in turn causes a voltage drop across the second resistor which provides a forward bias to said first and second high gain amplifier transistor circuits, said first high gain amplifier transistor when conducting develops a forward bias to said second high gain amplifier transistor causing said second high gain transistor to conduct, with positive regenerative feed-back through said fifth resistor, thereby putting said second high gain transistor into hard conduction, said hard conduction of said second high gain amplifier transistor provides adequate base current to said emitter follower transistor and thus drives said output transistor into high current conduction which provides a path for said power supply-firing capacitor to discharge through said output transistor and permits a detonator electrically connected across said tenth resistances to perform opener functioning.

3. An apparatus as recited in claim 2 wherein said opener setter means comprises:

a charge cycle start means for sensing the presence of said electronic time opener, said charge cycle start means having an input electrically coupled to said timing capacitor charge lead wherein said charge lead having a normal quiescent bias voltage thereon drops to near zero voltage due to the capacitive loading of said opener means and generates an output signal in response to said voltage drop;

a contact bounce delay one-shot means, electrically coupled to the output of said charge cycle start means, for providing a time delay to allow said switch means to make good contact for proper charging of said timing and firing capacitors, and for generating a positive output pulse after said time delay;

a precision one-shot means electrically coupled to the output of said contact bounce delay means and responsive thereto for generating a timing charge output pulse;

a timing charge transistor switch means electrically connected to the output of said precision one-shot means for coupling said timing charge output pulse voltage to said timing capacitor;

a precision resistor network means electrically coupled to said transistor switch means, for proving a specific resistance through which said timing capacitor is charged;

a time select switch means electrically connected to said precision resistor network means, for permitting the pilot of said aircraft to adjust said resistor network to a plurality of time settings and to a "safe" non-operative position;

a comparator circuit means electrically coupled to the output of said precision resistor network, for measuring the sum of the voltage on said timing firing capacitors and for generating an output signal when a preset level is reached;

a flip-flop means having a first and second input, said first input being electrically connected to said contact bounce delay means for switching the charge cycle voltage to said firing capacitor, said second input being electrically coupled to said comparator means for detecting, the transition of said comparator means when said charge cycle is to be stopped;

a firing charge limit one-shot means electrically connected to the output of said precision one-shot, for limiting the interval of time for charging said firing capacitor, and for protecting said setter means should the firing capacitor be shorted, said firing charge limit one-shot starts the charging of said firing capacitor immediately upon completing the charge of said timing capacitor;

a transistor gate means, electrically connected to the output of said flip-flop means and to the output of said firing charge limit one-shot means, one half of said transistor gate for charging said firing capacitor, the other half of said transistor gate for limiting the time to a maximum of 8 milliseconds for charging said firing capacitor; and a firing charge transistor switch, electrically connected to the output of said transistor gate means, for delivering a charge to said firing capacitor, wherein as said charge on said timing capacitor is being completed and said firing capacitor is being charged, said comparator monitors the sum of the voltage on said timing and firing capacitors and when a preset voltage level is reached, said comparator switches, setting said flip-flop means and opening said transmission gate thereby stopping the charging of said firing capacitor and thus completing said opener setter means charge cycle.

* * * * *